US007909456B2

(12) United States Patent
Suzuki et al.

(10) Patent No.: US 7,909,456 B2
(45) Date of Patent: Mar. 22, 2011

(54) IMAGE FORMING APPARATUS

(75) Inventors: Masato Suzuki, Kitaadachi-gun (JP); Makoto Kurata, Yokohama (JP); Masahiro Yonekawa, Machida (JP)

(73) Assignee: Ricoh Company Limited, Tokyo (JP)

( * ) Notice: Subject to any disclaimer, the term of this patent is extended or adjusted under 35 U.S.C. 154(b) by 827 days.

(21) Appl. No.: 11/695,294

(22) Filed: Apr. 2, 2007

(65) Prior Publication Data

US 2007/0236552 A1 Oct. 11, 2007

(30) Foreign Application Priority Data

Apr. 6, 2006 (JP) ..... 2006-105077
Mar. 6, 2007 (JP) ..... 2007-055558

(51) Int. Cl.
*B41J 29/13* (2006.01)

(52) U.S. Cl. ..... 347/108

(58) Field of Classification Search ..... None
See application file for complete search history.

(56) References Cited

U.S. PATENT DOCUMENTS

| | | | | |
|---|---|---|---|---|
| 5,090,675 | A * | 2/1992 | Nagai et al. | 271/10.12 |
| 6,785,488 | B2 | 8/2004 | Katsuyama | |
| 2006/0055757 | A1 * | 3/2006 | Yamashita et al. | 347/102 |
| 2006/0071389 | A1 * | 4/2006 | Kozaki et al. | 271/9.11 |

FOREIGN PATENT DOCUMENTS

| | | |
|---|---|---|
| JP | 11-43253 | 2/1999 |
| JP | 2004-226944 | 8/2004 |

* cited by examiner

*Primary Examiner* — Manish S Shah
*Assistant Examiner* — Alexander C Witkowski
(74) *Attorney, Agent, or Firm* — Oblon, Spivak, McClelland, Maier & Neustadt, L.L.P.

(57) ABSTRACT

An image forming apparatus including an image reading section; a sheet feeding section; an image forming section configured to form an image on the sheet of the receiving material fed from the sheet feeding section; and a sheet discharging section located below the image reading section and configured to discharge the sheet bearing the image fed from the image forming section, wherein the sheet discharging section includes an outlet from which the sheet bearing the image is drawn; an inlet which is located on an upstream side from the outlet relative to the sheet discharging direction and from which the sheet bearing the image is discharged by the image forming section; a sheet receiving portion which receives the sheet bearing the image discharged from the inlet; and a top wall, and wherein the top wall is slanting upward in the sheet discharging direction.

16 Claims, 9 Drawing Sheets

IMAGE FORMING APPARATUS

BACKGROUND OF THE INVENTION

1. Field of the Invention

The present invention relates to an image forming apparatus, such as copiers and printers.

2. Discussion of the Background

There is a background image forming apparatus having a configuration as illustrated in FIG. 1. Referring to FIG. 1, an image forming apparatus 100 includes an image reading section 101 configured to read an original image to be copied; a sheet feeding section 103 configured to feed a sheet S of a receiving material; an image forming section 105 configured to form an image on the sheet S fed from the sheet feeding section 103; and a sheet discharge section 107 to which the sheet bearing the image thereon is discharged.

As illustrated in FIG. 1, the sheet discharge section 107 projects from the main body of the image forming apparatus 100. Therefore, the image forming apparatus 100 has a problem such that an extra space is needed for the sheet discharging section.

In attempting to solve such a problem, published unexamined Japanese patent application No. (hereinafter referred to as JP-A) 2004-226944 discloses an image forming apparatus in which a sheet discharging section is formed in an space between an image reading section and a sheet feeding section. This image forming apparatus has a configuration such that the sheet receiving portion (i.e., the bottom portion) of the sheet discharging section to which copied sheets are discharged is parallel to the top wall of the sheet discharging section.

In addition, JP-A 11-043253 discloses an image forming apparatus in which a sheet discharging section is formed in an space between an image reading section and a sheet feeding section, wherein part of the operational panel is made of a transparent material so that part of the sheet discharging section can be observed from the outside.

However, the image forming apparatus disclosed by JP-A 2004-226944 has a drawback in that a copy of a print (hereinafter referred to as a copy) present on the sheet receiving portion is hardly observed by a standing adult person because the sheet discharging section is located at a level of the hip of the person and the visual line of the person is obstructed by the top wall of the sheet discharging section. Particularly, when a small-size sheet (such as post cards and envelops) is discharged, the sheet cannot be observed by a standing adult person. Further, it is troublesome to draw a copy from the sheet discharging section particularly when the sheet is a small-size sheet. This is because insertion of a hand is obstructed by the top wall of the sheet discharging section.

The image forming apparatus disclosed by JP-A 11-043253 has drawbacks in that since part of the operation panel is made of a transparent material, the number of parts constituting the image forming apparatus increases, resulting in increase of costs, and in addition the image forming apparatus has a complex configuration.

Because of these reasons, a need exists for an image forming apparatus in which a discharged sheet can be easily observed by a standing person, and in addition a copy can be easily drawn from the sheet discharging section.

SUMMARY OF THE INVENTION

As an aspect of the present invention, an image forming apparatus is provided which includes an image reading section configured to read an original image; a sheet feeding section configured to feed a sheet of a receiving material; an image forming section configured to form a copy image on the sheet of the receiving material fed from the sheet feeding section; and a sheet discharging section which is located below the image reading section and which is configured to discharge a copy fed from the image forming section. The sheet discharging section includes an outlet from which the copy is drawn; an inlet which is located on an upstream side from the outlet relative to the sheet discharging direction and from which the copy is discharged by the image forming section; a sheet receiving portion which receives the copy discharged from the inlet; and a top wall, wherein the top wall is slanting upward in the sheet discharging direction (i.e., the gap between the sheet receiving portion and the top wall is larger at the outlet of the sheet discharging section than at the inlet thereof).

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, a first example of the image forming apparatus of the present invention will be explained in detail by reference to FIGS. 2-4.

Figure 1:
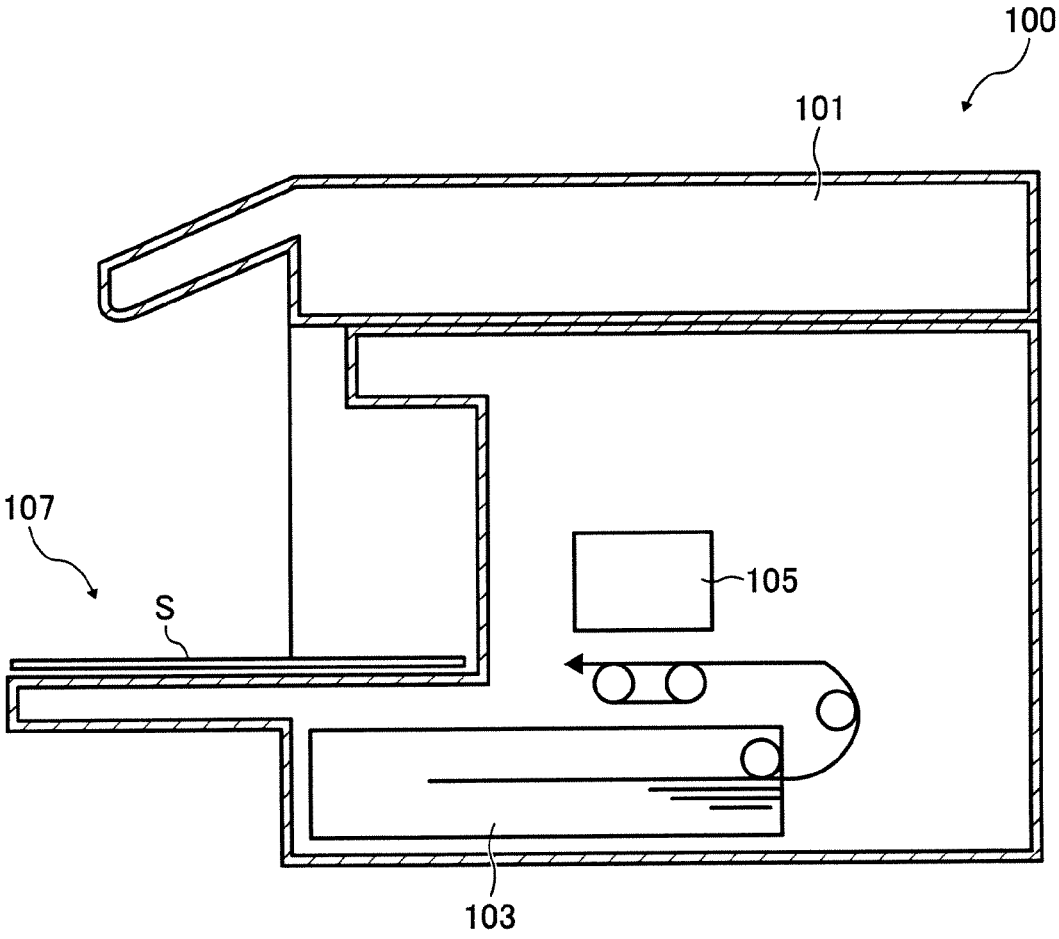
FIG. 1 BACKGROUND ART
FIG. 1 is a schematic vertical section illustrating a background image forming apparatus.
Figure 2:
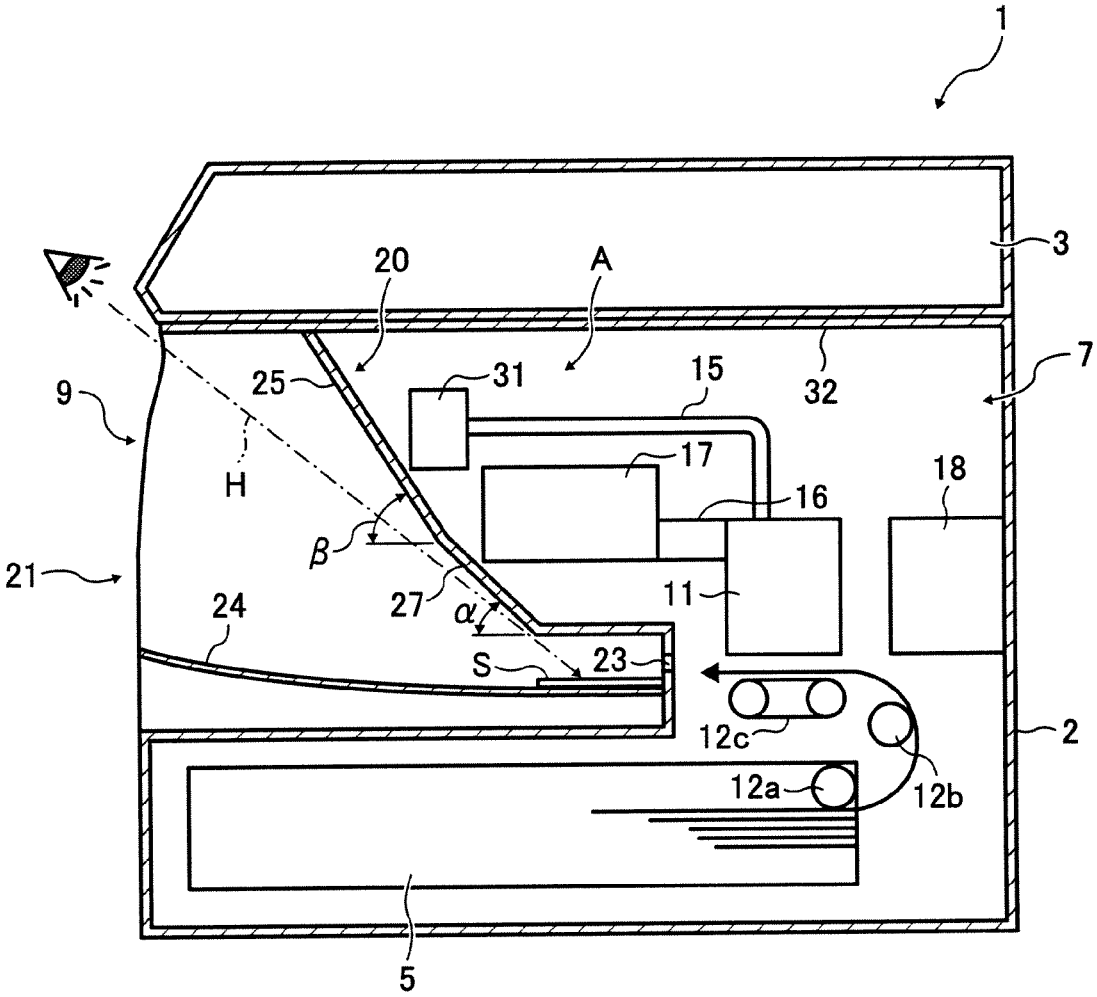
FIG. 2 is a schematic vertical section illustrating an example of the image forming apparatus of the present invention.
Figure 3:
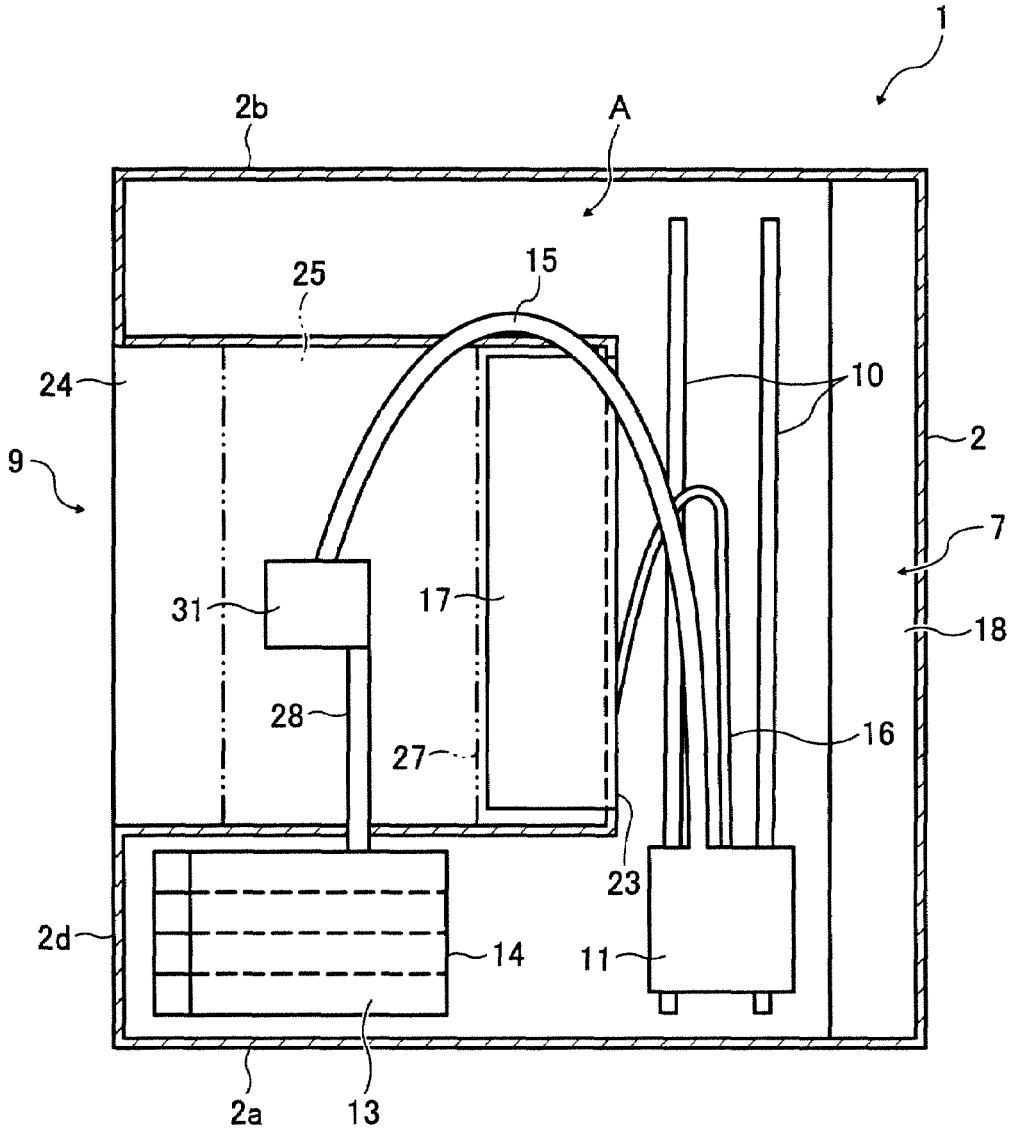
FIG. 3 is a schematic transverse sectional view illustrating the example of the image forming apparatus illustrated in FIG. 2.
Figure 4:
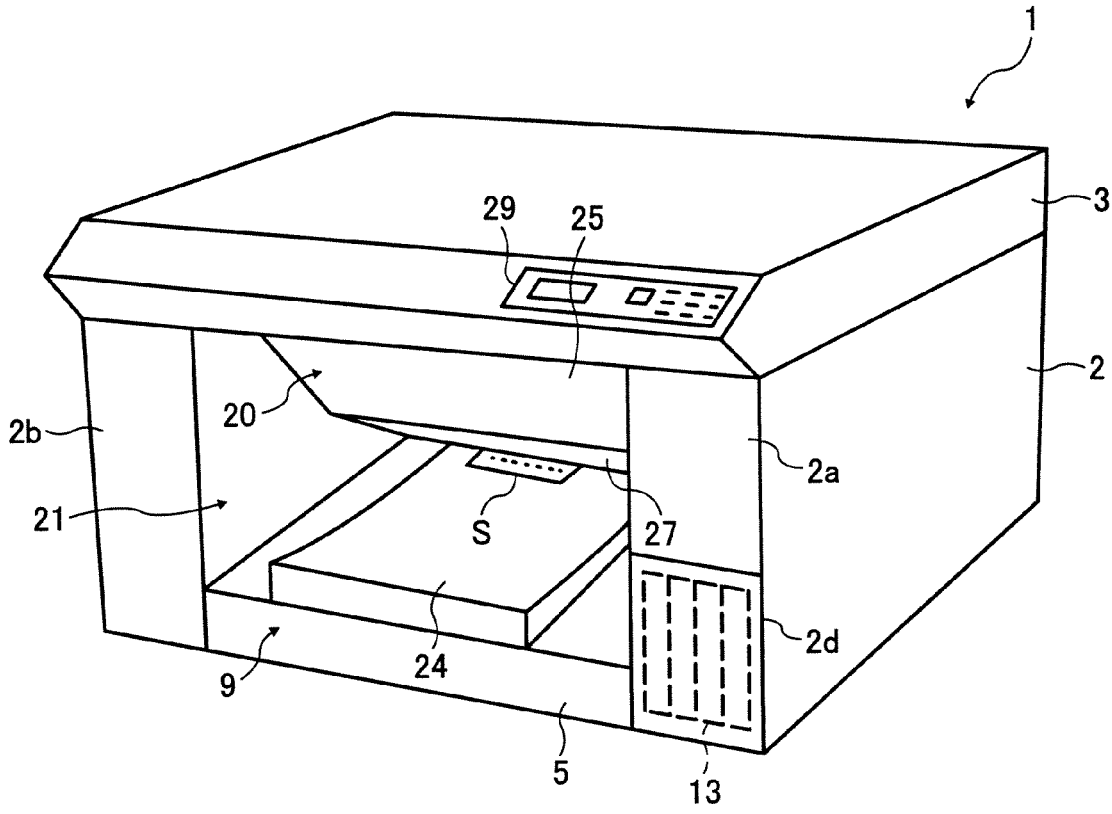
FIG. 4 is a schematic perspective view illustrating the example of the image forming apparatus illustrated in FIG. 2.

FIGS. 2-4 are respectively a vertical section, a transverse sectional view and a perspective view illustrating the first example of the image forming apparatus of the present invention.

Referring to FIGS. 2-4, an image forming apparatus 1 is an inkjet copier, and includes an image reading section 3 (serving as image reading means) configured to read the image of an original document; a sheet discharging section 9 (serving as sheet discharging means) located below the image reading section 3; a sheet feeding section 5 (serving as sheet feeding means) located below the sheet discharging section 9; and an image forming section 7 (serving as image forming means)

configured to form a copy of the original image on a sheet fed from the sheet feeding section 5 and to discharge the copy to the sheet discharging section 9. The sheet feeding section 5 and the image forming section 7 is arranged in a case 2 of the main body of the image forming apparatus.

The sheet feeding section 5 includes a pickup roller 12*a* configured to pickup an uppermost sheet S of sheets set in the sheet feeding section 5. The sheet S picked up the pickup roller 12*a* is fed by a feeding roller 12*b*, which is provided in a sheet feeding passage, to a feeding belt 12*c*, at which the sheet S faces a printhead 11.

The image forming section 7 is located so as to be adjacent to an inlet 23 of the sheet discharging section 9. As illustrated in FIG. 3, the image forming section 7 includes the printhead 11 (serving as inkjet means) which is supported by two guides 10 and which is driven by a driving device so as to make back and forth movement in a main scanning direction. The printhead 11 ejects ink drops toward the sheet S on the feeding belt 12*c* while the printhead makes back and forth movement in the main scanning direction and the sheet S is fed in the sub-scanning direction, resulting in formation of an image on the sheet S (i.e., formation of a copy).

The printhead 11 is connected with an ink tank 31 (serving as ink storage means) via an ink feeding tube 15 (serving as ink feeding means) to receive inks from the ink tank 31. In addition, the printhead 11 is connected with a power source 17 via a flexible cable 16 (i.e., a printhead control cable serving as inkjet controlling means). The power source 17, which also serves as a controller (controlling means), applies a driving power and a drive control signal to a driving motor (not shown) to drive the printhead 11 and the feeding belt 12*c*. Further, a drive control unit 18 is provided along the guides 10 in the case 2.

In the case 2 of the main body of the image forming apparatus, right and left portions 2*a* and 2*b* are provided on both sides of an outlet 21 of the sheet discharge section 9. An ink cartridge setting portion 14 (serving as ink cartridge receiving means) is provided in one of the right and left portions 2*a* and 2*b* so that an ink cartridge 13 can be set therein. In FIG. 3, the ink cartridge setting portion 14 is provided in the right side portion 2*a*. When the ink cartridge 13 is attached to or detached from the image forming apparatus 1, a front cover 2*d* (illustrated in FIG. 4) is opened. The ink cartridge setting portion 14 is connected with the ink tank 31 through a tube 28 (illustrated in FIG. 3) to supply inks to the ink tank 31.

The sheet discharging section 9 includes an inlet 23 from which a copy (i.e., a sheet bearing an image thereon) is discharged, a sheet receiving portion 24 (serving as sheet receiving means) which receives the copy discharged from the inlet 23, the outlet 21 from which the copy present on the sheet receiving portion 24 is drawn, and a top wall 20 facing the sheet receiving portion 24.

The top wall 20 is slanting upward in the direction of from the inlet 23 to the outlet 21. In addition, the top wall 20 has two slanting portions, i.e., first and second slanting portions 27 and 25. As illustrated in FIG. 2, the first slanting portion 27, which is near the inlet 23, has a slanting angle $\alpha$ and the second slanting portion 25, which is near the outlet 21, has a slanting angle $\beta$, wherein $\alpha<\beta$. In this regard, the slanting angle $\beta$ of the second slanting portion is preferably from 50° to 70° and more preferably about 60°. The slanting angle $\alpha$ of the first slanting portion is preferably from 30° to 50° and more preferably about 40°.

As illustrated in FIG. 2, the ink tank 31, the power source 17, the ink feeding tube 15, and the flexible cable 16 are arranged in a space A formed between the top wall 20 of the sheet discharging section 9 and a case top wall 32 of the case 2.

Next, the action and features of the image forming apparatus of the present invention will be explained. A print start signal is sent from an operation panel 29 (illustrated in FIG. 4 and serving as operation means), the pickup roller 12*a*, the feeding roller 12*b* and the feeding belt 12*c* are rotated to feed the sheet S in the sheet feeding section 5 one by one. Drops of color inks are ejected toward the sheet S from the printhead 11 which makes a back and forth movement in the main scanning direction while the sheet S is fed in the sub-scanning direction, to from a color image on the sheet S. The sheet S bearing the color image thereon is discharged from the inlet 23 of the sheet discharging section 9 so as to be stacked on the sheet receiving portion 24. The sheet S on the sheet receiving portion 24 is drawn from the outlet 21 by hand.

Since the sheet discharging section 9 has a configuration such that the top wall 20 thereof is slanting upward in the sheet discharging direction of from the inlet 23 to the outlet 21 (i.e., the space of the sheet discharging section 9 at the outlet side thereof is wider than that at the inlet side thereof), a visual line H (illustrated in FIG. 2) of a user standing in front of the image forming apparatus 1 is not obstructed by the top wall 20. Namely, the sheet S (i.e., the copy) on the sheet receiving portion 24 can be observed by the user even when the sheet S is a small-size sheet such as letters and envelops. Therefore, occurrence of a problem in that a copy remains in the sheet discharging section 9 without being drawn therefrom can be prevented.

In addition, since the sheet discharging section 9 has a configuration such that the top wall 20 thereof is slanting upward in the sheet discharging direction of from the inlet 23 to the outlet 21, a user can easily insert a hand into the sheet discharging section 9, and therefore a copy on the sheet receiving portion 24 can be easily drawn from the sheet discharging section 9.

Further, since the top wall 20 thereof is merely slanted upward in the sheet discharging direction, the sheet discharging section 9 has a simple configuration.

Furthermore, since the second slanting portion 25 of the top wall 20 has a greater slanting angle than the first slanting portion 27, the space of the sheet discharging section 9 on the side of the outlet 21 can be widened. Therefore, a copy on the sheet receiving portion 24 can be more easily drawn from the sheet discharging section 9.

Since the slanting angle $\alpha$ of the first slanting portion 27 is less than the slanting angle $\beta$ of the second slanting portion 25, the visual line H of a user, which is along the surface of the second slanting portion 25, is not obstructed by the surface of the first slanting portion 27, and therefore the visual line H can reach an inner portion of the sheet discharging section 9. Therefore, occurrence of a problem in that a copy remains in the sheet discharging section 9 without being drawn therefrom can be prevented even when the sheet has a small size (such as A-6 size sheets).

The ink tank 31, the power source 17, the ink feeding tube 15 and the flexible cable 16 are arranged in the space A formed between the top wall 20 and the case top wall 32 of the case 2, the space A is effectively used. Therefore, the image forming apparatus has a compact configuration.

Further, the ink cartridge 13 is set in the ink cartridge setting portion 14 provided in the right side portion 2*a* without projecting from the main body of the image forming apparatus, and therefore the image forming apparatus has good appearance.

Next, other examples of the image forming apparatus will be explained by reference to FIGS. 5-9. Since like reference characters designate like corresponding parts in FIGS. 2-9, the detailed explanation of the parts, which have been explained above in the first example, is omitted here and the difference between the examples and the first example will be mainly explained.

Figure 5:
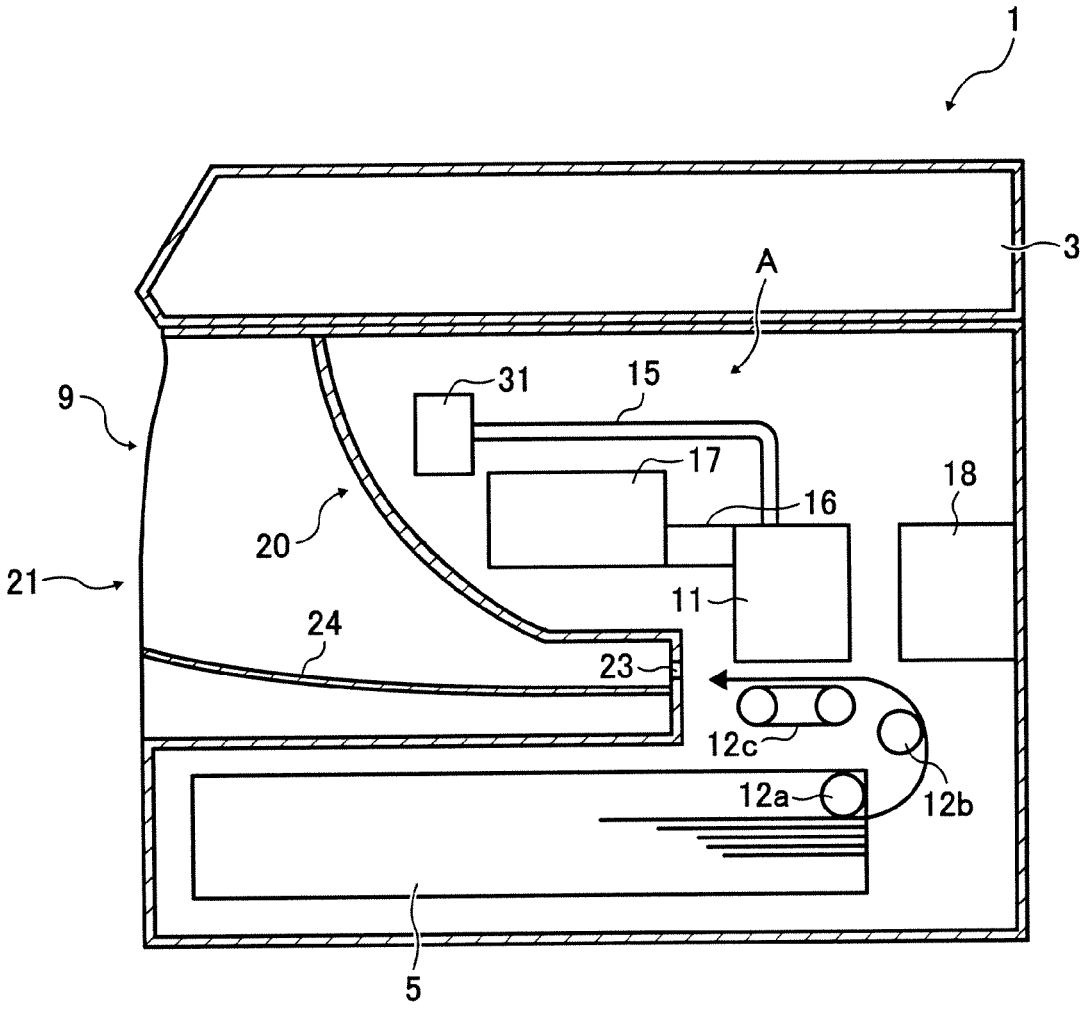
FIG. 5 is a schematic vertical sectional view illustrating another example of the image forming apparatus of the present invention.

FIG. 5 illustrates a second example of the image forming apparatus of the present invention.

In the image forming apparatus, the top wall 20 of the sheet discharging section 9 is slanting upward in the sheet discharging direction, wherein the surface of the top wall 20 is curved. This second example also has the same action and features as those of the first example.

Figure 6:
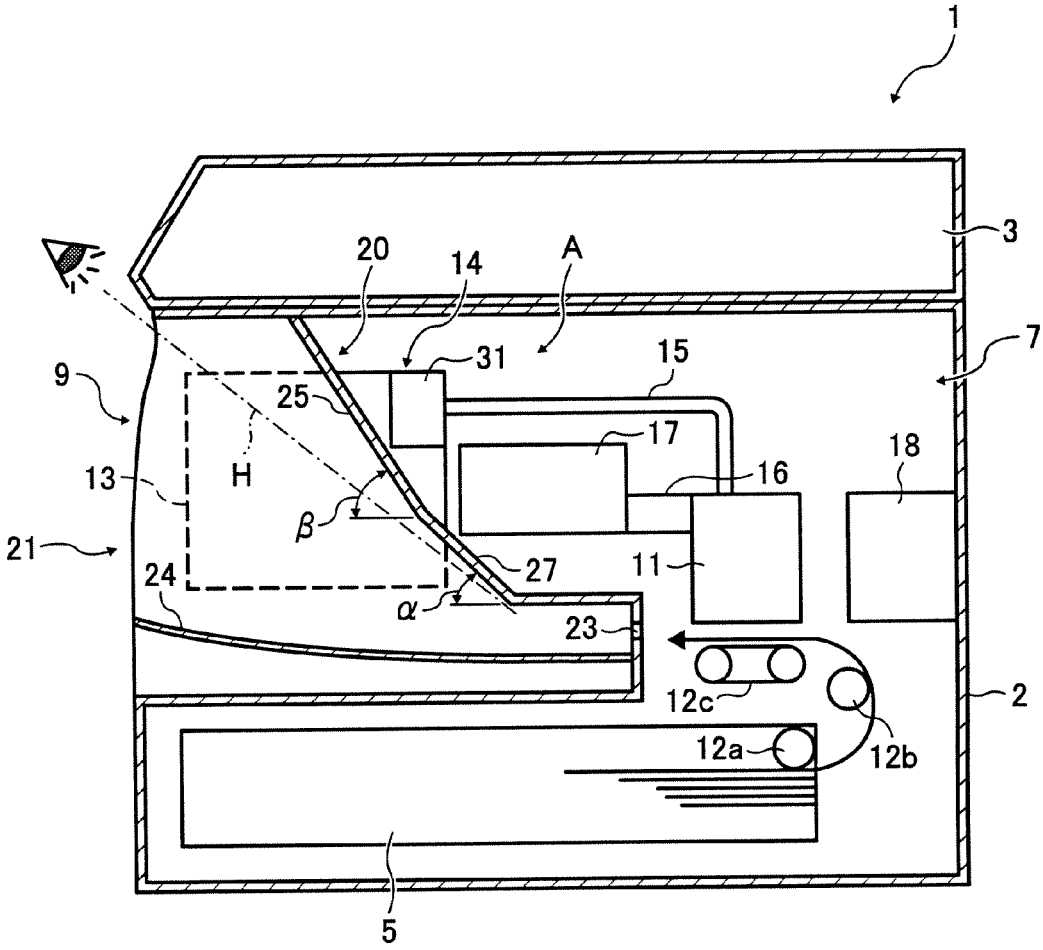
FIG. 6 is a schematic vertical section illustrating yet another example of the image forming apparatus of the present invention.
Figure 7:
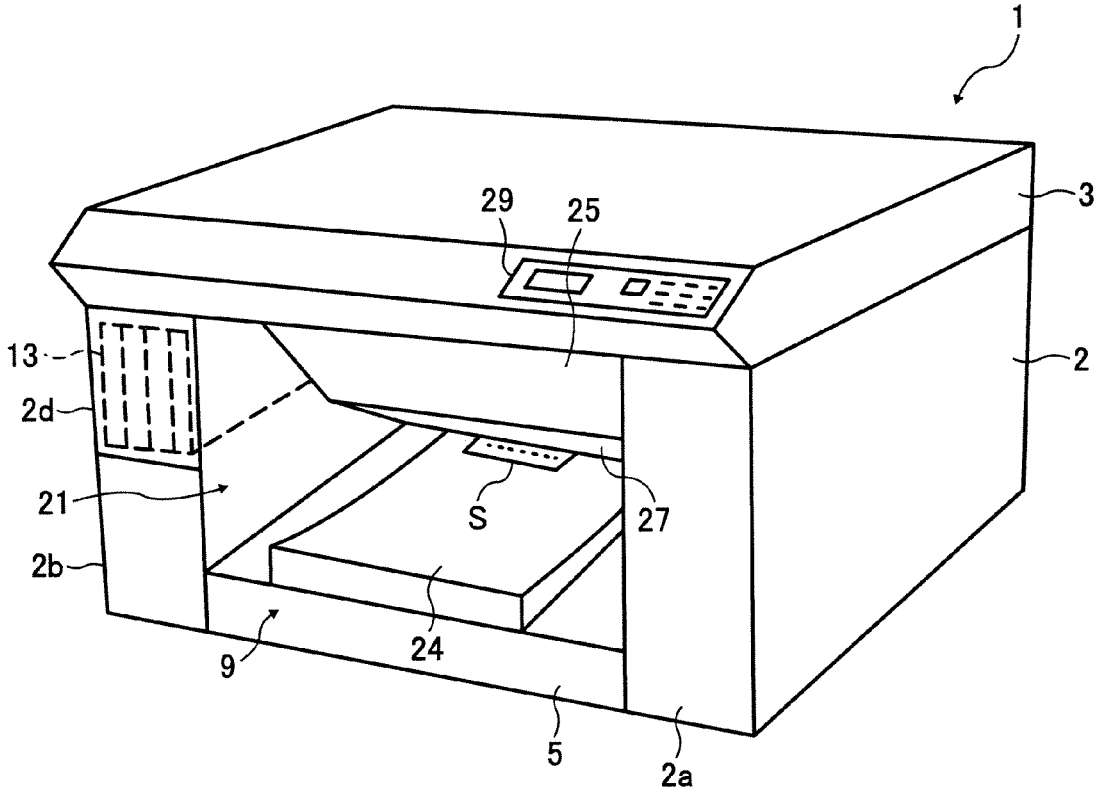
FIG. 7 is a schematic perspective view illustrating the example of the image forming apparatus illustrated in FIG. 6.

FIGS. 6 and 7 illustrate a third example of the image forming apparatus of the present invention. In the third example, the ink cartridge setting portion 14 is provided on an upper portion 2*d* of the left side portion 2*b* of the main body of the image forming apparatus 1. As illustrated in FIG. 6, the ink cartridge setting portion 14 is located on an upper level or the same level as that of the ink tank 31. Therefore, a pump configured to feed the inks from the ink cartridge setting portion 14 to the ink tank 31 can feed the inks with a low driving force.

Figure 8:
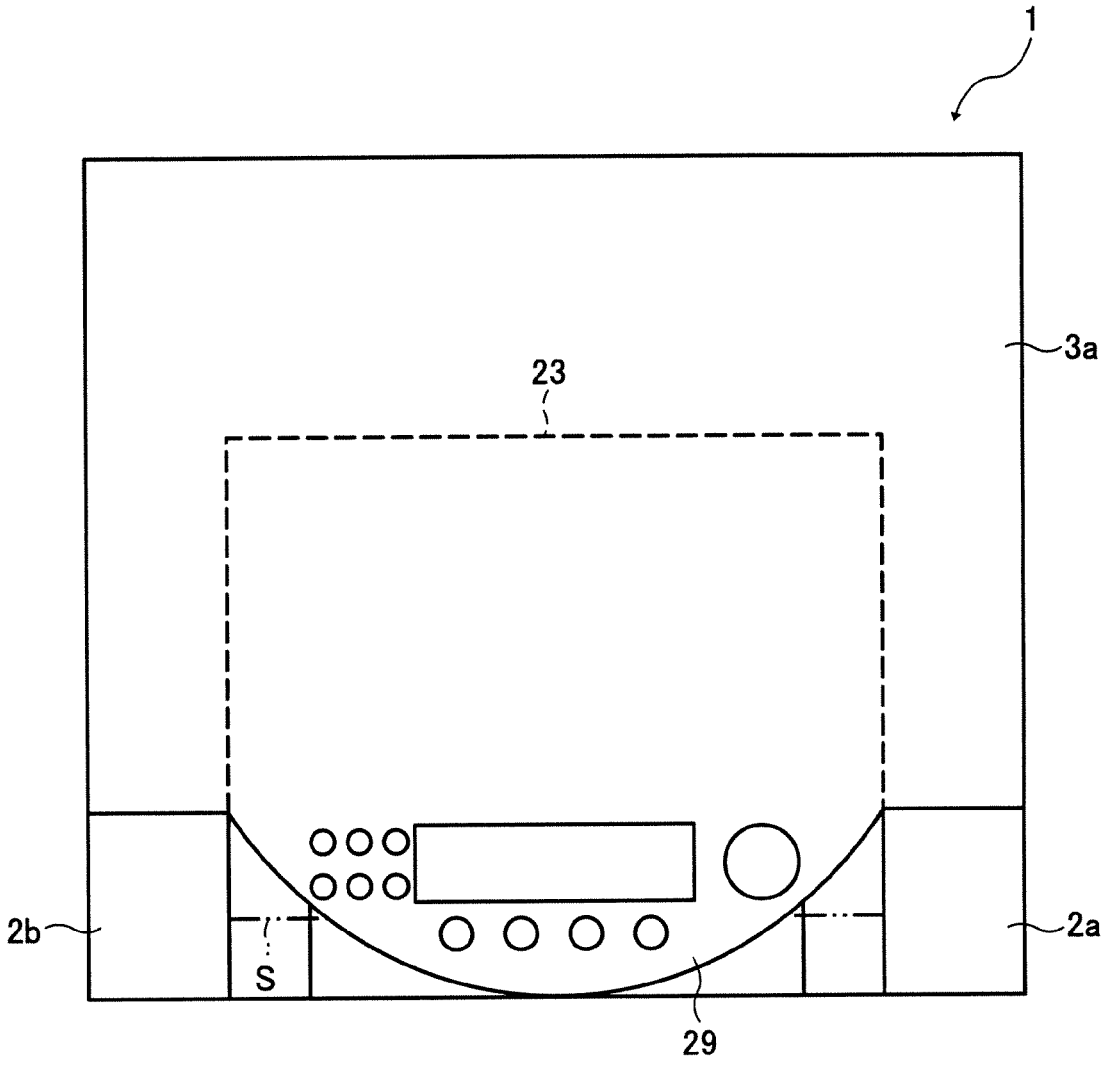
FIG. 8 is a schematic top plan view illustrating a further example of the image forming apparatus of the present invention.
Figure 9:
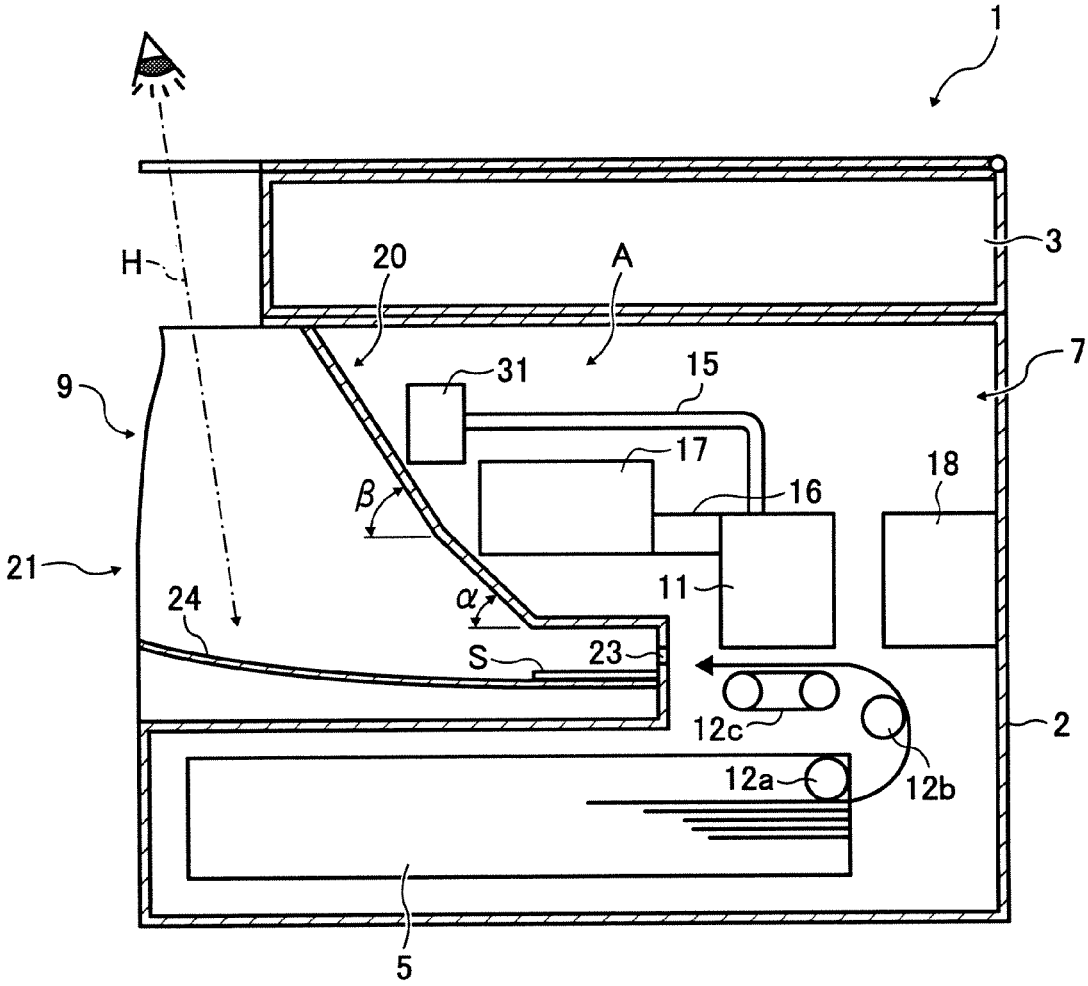
FIG. 9 is a schematic vertical section illustrating the example of the image forming apparatus of the present invention illustrated in FIG. 8.

FIGS. 8 and 9 illustrate a fourth example of the image forming apparatus of the present invention. An original pressing member 3*a* of the image reading section 3 has the operation panel 29 on a front side thereof. As illustrated in FIG. 8, both of right and left side portions of the operation panel 29 are recessed in the direction of from the front side of the image forming apparatus to the rear side thereof. Namely, the operation panel 29 has a shape like a character D as illustrated in FIG. 8. Therefore, both of the side portions of the sheet receiving portion 24 can be observed through the recessed right and left side portions of the operation panel by a user standing in front of the image forming apparatus 1 as illustrated in FIG. 9. Therefore, occurrence of a problem in that a copy remains in the sheet discharging section 9 without being drawn therefrom can be prevented.

The image forming apparatus of the present invention is not limited to the above-described examples and many changes and modifications can be made thereto without departing from the spirit and scope of the invention.

For example, the surfaces of the first and second slanting portions 27 and 25 are flat in the image forming apparatus illustrated in FIG. 2, but the surfaces may be curved.

In addition, in the second example of the image forming apparatus illustrated in FIG. 5, the surface of the top wall 20 is curved toward the outlet 21, but may be curved in the opposite direction.

This document claims priority and contains subject matter related to Japanese Patent Applications Nos. 2006-105077, and 2007-055558 filed on Apr. 6, 2006, and Mar. 6, 2007, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image reading section configured to read an original image;

a sheet feeding section configured to feed a sheet of a receiving material;

an image forming section configured to form an image on the sheet of the receiving material fed from the sheet feeding section; and a sheet discharging section located below the image reading section and configured to discharge the sheet bearing the image fed from the image forming section, the sheet discharging section including an opening from which the sheet bearing the image is collectable, a discharge point from which the sheet, bearing the image, is discharged by the image forming section, the discharge point being located on an upstream side from the opening relative to a sheet discharging direction, a sheet receiving tray to receive the sheet bearing the image discharged from the discharge point, and a top wall connected to the discharge point and located under the image reading section, the top wall slanting upward in a sheet discharging direction.

2. The image forming apparatus according to claim 1, wherein the top wall has a plurality of slanting portions in the sheet discharging direction, and a last slanting portion closest to the opening has a greater slanting angle than a first slanting portion closest to the discharge point.

3. The image forming apparatus according to claim 1, further comprising:

a case in which the image forming section is arranged the image forming section including an inkjet printhead configured to eject drops of color inks to form the image on the sheet of the receiving material, a controller configured to control driving of the inkjet printhead, and an ink tank configured to supply the color inks to the inkjet printhead, wherein at least one of the controller and the ink tank is located in a space above the top wall.

4. The image forming apparatus according to claim 3, wherein the image forming section further includes an ink feeding tube through which inks in the ink tank are supplied to the inkjet printhead, the ink feeding tube being located in the space above the top wall.

5. The image forming apparatus according to claim 3, wherein the image forming section further includes an inkjet printhead controlling cable through which the controller controls the inkjet printhead, the inkjet printhead controlling cable being located in the space above the top wall.

6. The image forming apparatus according to claim 3, wherein the case includes two side portions and the image forming section further includes an ink cartridge setting portion where an ink cartridge is set, wherein an edge of the ink cartridge setting portion closest to the discharge point is located at a side of the space above the top wall.

7. The image forming apparatus according to claim 3, wherein the image reading section includes an operation panel having two side portions recessed toward the discharge point such that both side portions of the sheet receiving tray are observable through the two side portions.

8. The image forming apparatus according to claim 1, wherein the top wall is curved in a concave shape extending towards the opening.

9. The image forming apparatus according to claim 1, wherein the opening is formed by at least the sheet receiving tray and the top wall.

10. An image forming apparatus comprising:

image reading means for reading an original image;

sheet feeding means for feeding a sheet of a receiving material;

image forming means for forming an image on the sheet of the receiving material fed from the sheet feeding means; and sheet discharging means for discharging the sheet bearing the image fed from the image forming means, the sheet discharging means including opening means for obtaining the sheet bearing the image, discharge means for providing an opening from which the sheet, bearing the image, is discharged by the image forming means, sheet receiving means for receiving the sheet bearing the image discharged from the discharge means, and walling means for increasing a space from which the sheet bearing the image is drawn.

11. The image forming apparatus according to claim 10, wherein the walling means has a plurality of slanting portions in a sheet discharging direction, and a last slanting portion closest to the opening means has a greater slanting angle than a first slanting portion closest to the discharge means.

12. The image forming apparatus according to claim 10, further comprising:

casing means for enclosing the image forming means, the image forming means including inkjet means for ejecting drops of color inks to form the image on the sheet of the receiving material, controlling means for controlling driving of the inkjet means, and ink storage means for supplying the color inks to the inkjet means, wherein at least one of the controlling means and the ink storage means is located in a space above the walling means.

13. The image forming apparatus according to claim 12, wherein the image forming means further includes ink feeding means for feeding the inks supplied from the ink storage means to the inkjet means, the ink feeding means being located in the space above the walling means.

14. The image forming apparatus according to claim 12, wherein the image forming means further includes:

inkjet controlling means through which the controlling means controls the inkjet means, the inkjet controlling means being located in the space above the walling means.

15. The image forming apparatus according to claim 12, wherein the casing means includes two side portions and the image forming means further includes ink cartridge receiving means for receiving an ink cartridge, wherein an edge of the ink cartridge receiving means closest to the discharge means is located at a side of the space above the walling means.

16. The image forming apparatus according to claim 12, wherein the image reading means includes operation means having two side portions recessed toward the discharge means such that both side portions of the sheet receiving means are observable through the two side portions.

* * * * *